United States Patent [19]

Poehlein et al.

[11] Patent Number: 4,928,141

[45] Date of Patent: May 22, 1990

[54] BUCKLE CONTROL FOR REDUCING INTERACTIONS BETWEEN MEDIA DRIVE SYSTEMS

[75] Inventors: Raymond E. Poehlein, Fairport; Franklin S. Reese, Victor; John A. Adamek, Rochester, all of N.Y.

[73] Assignee: Xerox Corporation, Stamford, Conn.

[21] Appl. No.: 313,552

[22] Filed: Feb. 22, 1989

[51] Int. Cl.[5] ..... G03G 21/00; G03G 15/20

[52] U.S. Cl. ..... 355/208; 355/282; 355/309

[58] Field of Search ..... 355/203, 204, 208, 282, 355/285, 289, 290, 308, 309

[56] References Cited

U.S. PATENT DOCUMENTS

| | | | |
|---|---|---|---|
| 3,774,907 | 11/1973 | Borostyan | 271/80 |
| 3,794,417 | 2/1974 | Machmer | 355/3 |
| 4,017,065 | 4/1977 | Poehlein | 271/80 |
| 4,025,187 | 5/1977 | Taylor et al. | 355/14 |
| 4,595,279 | 6/1986 | Kuru et al. | 355/282 |
| 4,689,471 | 8/1987 | Pirwitz et al. | 219/216 |

*Primary Examiner*—A. T. Grimley
*Assistant Examiner*—Ed Pipala

[57] ABSTRACT

In a document copier/printer wherein copy sheet is of a length which exceeds the distance between a transfer station and a fusing station, a velocity differential is established between the two stations so that the copy sheet forms a buckle therebetween which varies from an initial position, and in a predetermined direction, during operation. A sensor detects when the buckle reaches a predetermined configuration and sends a signal to one of the two stations to change the media speed at that location for a length of time sufficient to restore the buckle to the original configuration. The cycle may be repeated several times during a process run.

5 Claims, 2 Drawing Sheets

BUCKLE CONTROL FOR REDUCING INTERACTIONS BETWEEN MEDIA DRIVE SYSTEMS

BACKGROUND AND PRIOR ART STATEMENT

The present invention relates, generally, to a reprographic copying apparatus and, more particularly, to a control system for controlling the relative drive speeds of the media sheet transfer surface and a fusing roller assembly. In a transfer process such as conventional transfer xerography, a developed image pattern on a photoreceptor surface is transferred to a copy sheet which then passes through a fusing station so as to permanently fuse the toner image to the copy sheet surface, thereby preventing smearing or disturbance of the toner image by mechanical agitation or electrical fields. For this reason, and also for reasons of simplifying and shortening the paper path of the copier, and also for space savings, it is desirable to maintain the fusing station as close as possible to the transfer station. A particularly desirable fusing operation incorporates a roll-type fuser wherein the copy sheet is passed through a pressure nip between two rollers or a heated roller and a biased web. An example of this latter type of system is described in U.S. Pat. No. 4,689,471 assigned to the same assignee as the present invention.

However, when the fuser station is located near enough to the transfer station so that a lead portion of the copy sheet is in the fuser roll station simultaneously with the rear or trailing portion of that same copy sheet still being in contact with the photoreceptor, than a serious problem can arise. The problem is manifested in smears or skips in the unfused toner image which has been, or is being, transferred to the trailing portion of the copy sheet. This condition is caused by relative movement or slippage between the photoreceptor and the copy paper in those areas where they are still in contact, i.e., which have not yet been stripped away from the photoreceptor. A cause of such slippage is a speed mismatch between the nip speed of the fuser station (the speed at which the fuser is pulling the lead edge of the paper through the fuser) and the surface speed of the photoreceptor. If the fuser roll nip speed is slower, maximum buckle exists and the copy sheet can slip backwards relative to the photoreceptor. If the fuser roll is faster, the copy sheet can be pulled forward relative to the image on the photoreceptor. Eiether phenomenon can cause the aforementioned smears or skips in the toner image being transferred to the trailing area of the copy sheet.

An exactly equal velocity drive connection between the photoreceptor and the fuser is difficult, if not impossible, to maintain. Also, there is a further complication in that the actual sheet driving velocity at the fuser roll nip can change with changes in the effective diameter of the fuser driving roll. This can occur from replacement of the rollers, or changes in the applied nip pressure, materials aging, temperature effects, etc. Thus, equal speed is nearly impossible to maintain between the fuser roll nip and the photoreceptor surface in a commercial apparatus and may require increased maintenance and speed adjustment mechanisms.

Where the spacing between the fusing station and the transfer station is greater than the dimensions of the copy sheet, and a separate two-speed sheet transport is provided therebetween, then substantially different fuser roll nip speeds can be provided for as in U.S. Pat. No. 3,794,417, issued Feb. 26, 1974, to J. A. Machmer. However, this system has the noted disadvantages of requiring additional space, increased unfused image sheet handling, and also entails the additional complexity and expense of the additional transport mechanism.

It is known in the copying art to form a buckle in a copy sheet in its movement through the copier at various locations and for other functions. For example, it is known to interrupt the forward movement of a copy sheet with registration fingers and to form a buckle in the copy sheet by its continued feeding by upstream feed rollers to provide registration of the lead edge of the copy sheet before the copy sheet is fed into the image transfer station, e.g., U.S. Pat. No. 3,601,392, issued Aug. 24, 1971, to Merton R. Spear, Jr., et al. It is also known to provide or pre-form a buckle in a web of copy material to compensate for the braking of the web during a cutting operation in which the web is cut into individual sheets, e.g., U.S. Pat. No. 3,882,755, issued May 13, 1975, to Alan F. McCarroll. The later patent also illustrates that the copy web may be preformed into an initial convex buckle over an apertured surface and that air pressure may be utilized to expand the buckle when the web is stopped downstream thereof.

U.S. Pat. No. 3,774,907, issued Nov. 27, 1973, to Stephen Borostyan illustrates a vacuum sheet stripping device for removing copy sheets from the initial image support member and advancing them to a roll fuser, wherein the copy sheets assume a convex shape. A rotating cylindrical apertured vacuum is automatically cut off to the vacuum stripping member to release the copy sheet.

It is also known in the art to form a buckle specifically in the area between the transfer and fusing station. U.S. Pat. No. 4,017,065, issued Apr. 12, 1977 to Raymond E. Poehlein, discloses a speed mismatch compensation system which allows the fusing roll nip to be closely spaced from the transfer station of an electrostatographic copier by a distance less than the movement dimension of an individual copy sheet. The intermediate portion of the copy sheet is selectively supported and guided in a manner so as to form a buckle which accommodates a speed differential between the fuser roll nip velocity and the velocity of the photoreceptor. The fuser roll nip velocity is pre-set to always provide a somewhat faster speed than that of the photoreceptor. The speed mismatch is then accommodated by a reduction in the buckle rather than forward slippage on the photoreceptor. This allows a fixed and uncritical fuser roll drive which does not have to be adjusted relative to the photoreceptor surface drive.

In U.S. Pat. No. 4,025,187 issued May 24, 1977 to Taylor et al., a second type of buckle control system is disclosed that uses a reference time interval for feeding a sheet against a stop member to form a buckle in the sheet. After expiration of the time interval, the sheet separator is deactivated. A leading edge sensor and a buckle sensor feed signals to control the timing interval.

A drawback to the above described buckle control systems is that they are directed toward constantly maintaining the buckle at an exact configuration or are limited in the length of the sheet that can be accomodated. Precise control systems, typically using servo motors, are normally required. It would be desirable to provide a speed mismatch system which permits the buckle size to vary around an optimum size and which utilizes a simple drive system which can selectively drive one or the other of the two mismatched systems to periodically restore the buckle to an optimum configuration. Accordingly, the invention is directed to a system which utilizes a controlled buckle between two media drive systems. More particularly, the invention is directed towards a system for controlling the movement of a copy media, a portion of which is in frictional contact between a first and second rotational surface, and forms a buckle there between, the system including first drive means for controlling the rotational speed of said first surface, second drive means for controlling the rotational speed of said second surface, said first and second drive means resulting in a speed mismatch which creates a change in said buckle and a sensing means for sensing a predetermined buckle size in the portion of the copy media moving between the two rotational surfaces said sensing means adapted to generate an output signal for a predetermined length of time, said sensor output signal applied to one of said drive means so as to cause a change in the speed of said drive means whereby the said buckle configuration is restored to its original configuration.

BRIEF DESCRIPTIONS OF THE DRAWINGS

DETAILED DESCRIPTION OF THE INVENTION

Figure 1:
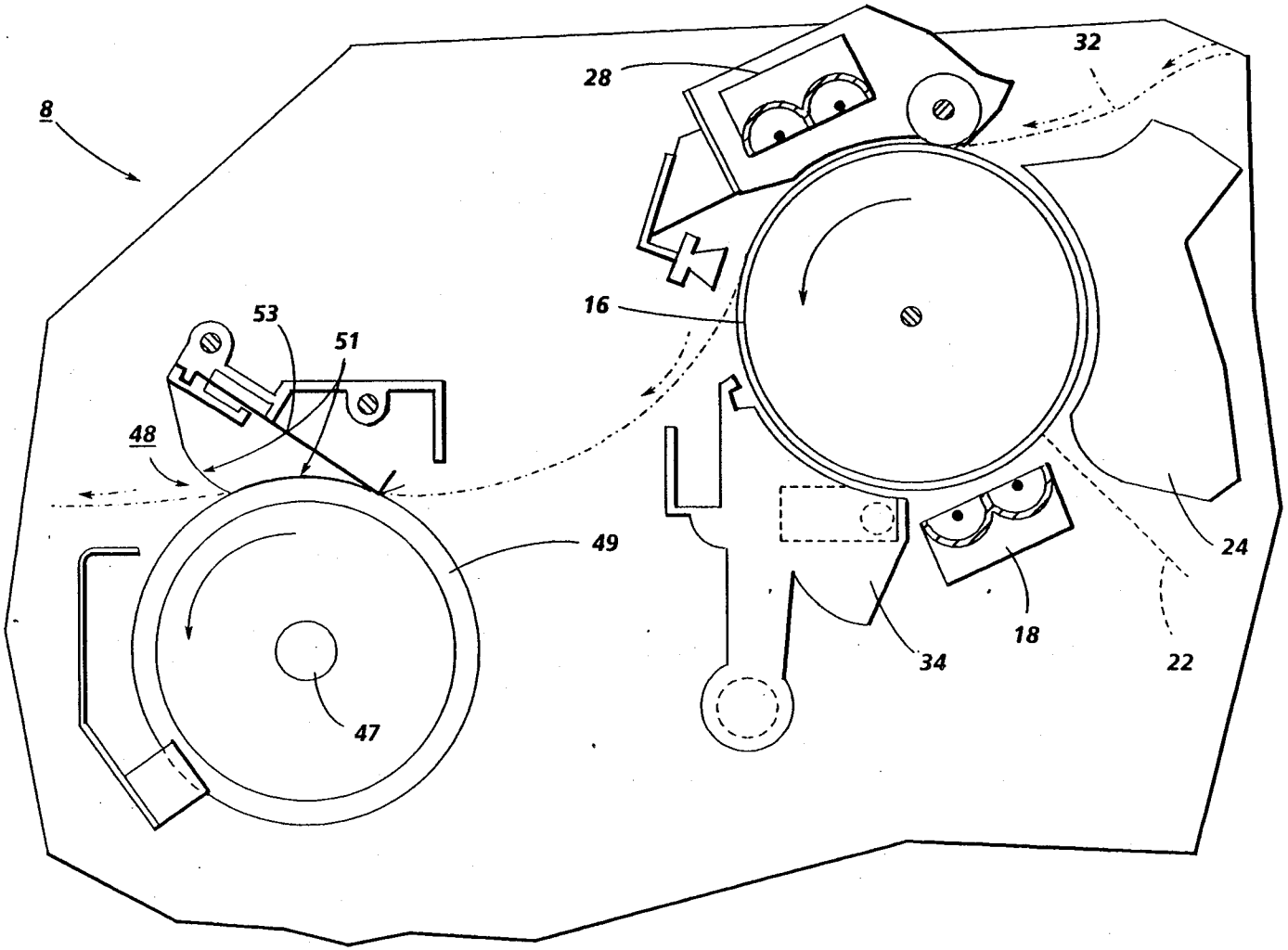
FIG. 1 is a cross-sectional side view of an exemplary xerographic copying apparatus, illustrating those portions thereof relevant to the description of the present invention.

Referring to FIG. 1 of the drawings, there is shown a portion of a xerographic machine 8 illustrating the various optical and xerographic stations. Briefly, as will be familiar to those skilled in the xerographic printing and copying arts, the xerographic components of the machine include a charge retentive recording member shown here in the form of a rotatable photoreceptor 16. In the exemplary arrangement shown, photoreceptor 16 comprises a drum having a photoconductive surface. Other photoreceptor types such as belt, web, etc. may instead be employed.

Operatively disposed about the periphery of photoreceptor 16 are a charging station 18 for placing a uniform charge on the photoconductive surface of photoreceptor 16 and exposure station 22 where the previously charged photoconductive surface is exposed. The surface is exposed to form a latent image either by light rays reflected from a scanned document and projected by a lens or by a raster input scanner (RIS) whose output is a modulated light beam which "writes" upon the drum surface to form a latent image according to the input information regulating the RIS. Continuing with the system description, the latent electrostatic image created on the photoconductive surface is developed by toner at development station 24. The transfer portion of the combined transfer and detack station 28 provides for sequentially transferring the developed image to a suitable copy substrate material such as a copy sheet 32 brought forward in timed relation with the developed image on, photoreceptor 16 surface. The detack charge process lessens the forces of attraction between the copy sheet and the photoreceptor surface. Cleaning station 34 removes leftover toner from the photoconductive surface, and neutralizes residual charges thereon.

Copy sheet 32 is brought forward to transfer station 28 by a gripper bar system (not shown). Following transfer, the sheet 32 is carried forward to a fusing station 48 where the toner image is contacted by fusing roll 49 which forms one member of a heat and pressure fuser. Fusing roll 49 is heated by a suitable heat source such as quartz lamp 47 disposed within the interior of roll 49. After fusing, the copy sheet 32 is discharged from the machine onto an appropriately placed output tray. The fuser apparatus 48 also includes a nonrotating, elongated pressure member such as a web or sling 51 biased to form an entrance nip and to maintain the copy paper in contact with the fuser roll through the fusing area. Web 51 is biased against the fuser roll surface by a blade 53. Further details of such a fuser apparatus are described in U.S. Pat. No. 4,629,471, which contents are hereby incorporated by reference.

For purposes of describing the present invention, it is assumed that the document being copied is a relatively long document such as on engineering drawing, e.g. up to 15 feet or longer in length. Copy sheet 32 will therefore be cut to the same length. Because of this atypical length, portions of copy sheet 32 will, as shown, be simultaneously within the transfer station 28 and fuser station 48. As explained in the introduction, unless otherwise compensated for, velocity differences in the rotational speed of photoreceptor 16 and fuser roll 49 can create image quality problems. If the photoreceptor drum 16 is moving the copy sheet 32 faster than the fuser roll 49, a buckle will form in the portion of the copy sheet located between the transfer and fuser station. If the buckle becomes to large, as would likely happen when copying a long document, the copy sheet may come in contact with adjacent portions of the machine, damaging the image and possibly contaminating the interior. If, on the other hand, the fuser roll is rotating faster than drum 19, any buckle in the copy sheet will be pulled out, and the copy sheet will slip forward on the drum surface, again resulting impaired in image quality.

Figure 2:
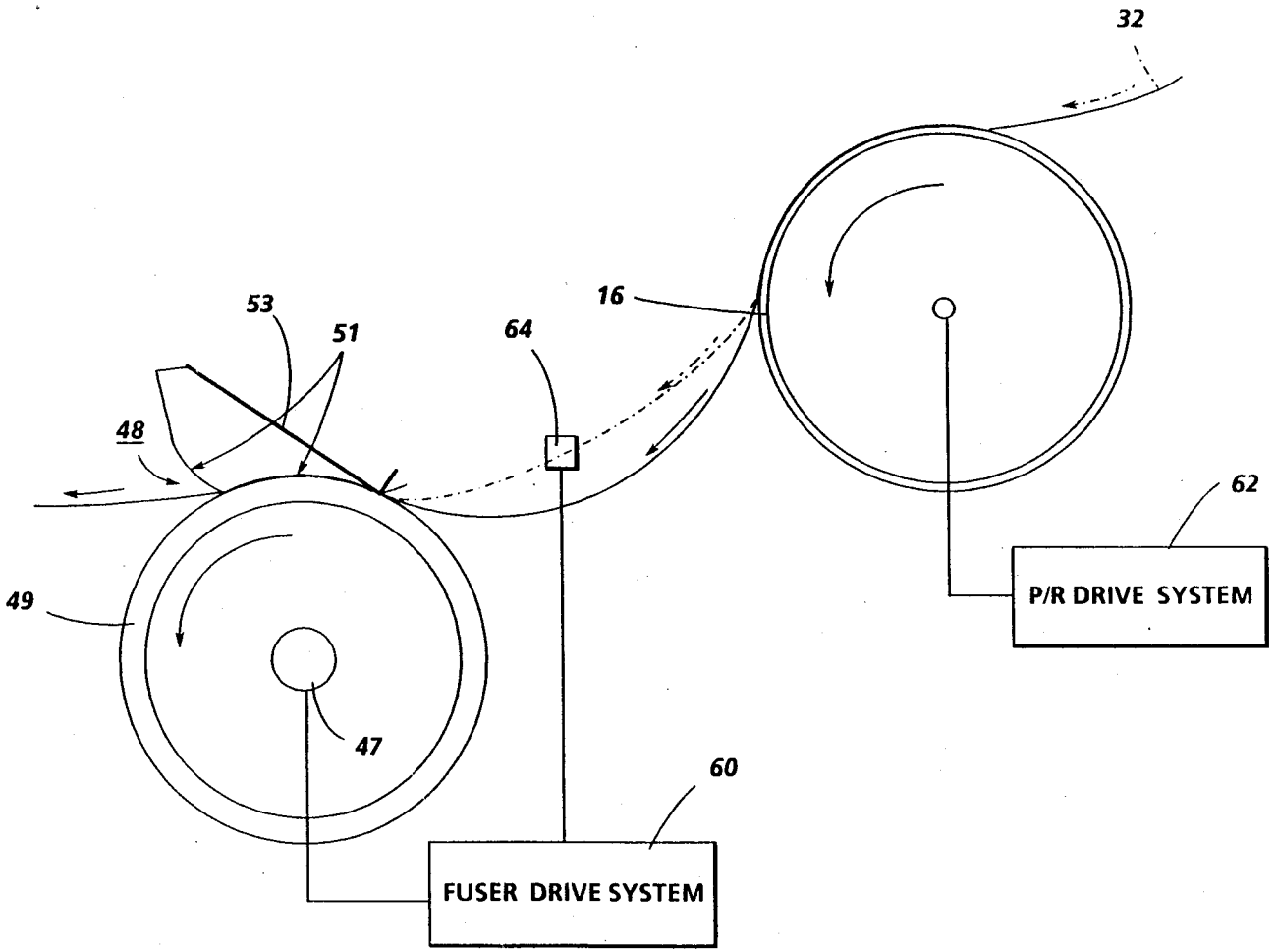
FIG. 2 is a side view of the transfer and fusing stations illustrating the process of buckle formation and control.

According to a first aspect of the invention and referring to FIG. 2, a first drive system 60 drives fuser roll 49 at a surface velocity $V_1$ which is equal to, or greater than, the surface velocity of photoreceptor 16 driven by second drive system 62. Assuming the copy sheet 32 initially assumes a buckle configuration, (solid line) and assume further that a buckle of this size is optimally contained within the machine so that it does not come into contact with other portions of the machine. Since fuser roll 49 is driving copy sheet 32 equal to or faster than photoreceptor 16, this buckle will normally either be constant or decreasing, respectively. A predetermined minimum buckle position is shown as a dotted line. At this buckle position, there is still no slippage at the transfer surface. A sensor system 64 is aligned with this low level position. Sensor system 64 may be an optical or mechanical sensor. If the fuser roll is actively driving the copy faster then the trailing edge at the transfer station, the predetermined minimum buckle position will be attained. When this low level buckle is detected, a signal is sent to drive system 60, which, in a preferred embodiment includes a stepper motor. The motor, connected to the fuser roll shaft reduces the velocity of roll 49 to a second velocity $V_2$ (less than the photoreceptor velocity) for a predetermined length of time to reestablish a larger buckle. Once the predetermined length of time has expired, fuser roll 49 is again rotated at initial velocity $V_1$. The buckle may again begin to decrease until it is again detected by sensor 64. This cycle may repeat itself several times as needed during the interval that sheet 32 is traveling between the transfer and fusing stations.

Consistent with the principles of the buckle control of the present invention, other drive system mismatches can be used. For example, fuser drive system 60 could drive the fuser roll 49 slower than the speed applied to the photoreceptor by drive system 62. The sensor 64 would then be aligned so that it would detect a high buckle level and the signal to the drive system 60 would then increase the fuser roll speed for a predetermined time to reduce the buckle size. Alternatively the drive system 62 could be used to receive the output speed of sensor 64 and change its speed accordingly.

The invention is therefore intended to cover such modifications or changes as may come within the scope of the following claims:

What is claimed is:

1. A system for controlling the movement of a copy media a portion of which is in frictional contact between a first and a second rotational surface and forms a buckle therebetween, the system including first drive means for controlling the rotational speed of said first surface, second drive means for controlling the rotational speed of said second surface, said first and second drive means resulting in a speed mismatch which creates a change in said buckle and a sensing means for sensing a predetermined buckle size in the portion of the copy media moving between the two rotational surfaces said sensing means adapted to generate an output signal for a predetermined length of time, said output signal applied to one of said drive means so as to cause a change in the speed of said drive means whereby the said buckle configuration is restored to its original configuration.

2. In a copying system in which an unfused image of imaging material is transferred from a moving photoreceptor surface onto one side of a copy sheet while said copy sheet overlies the surface and moves therewith, and in which a lead area of the transferred unfused image-bearing copy sheet is then engaged by a roll fusing assembly spaced from the photoreceptor while a trail area of the same copy sheet is still moving with the photoreceptor surface, with the copy sheet extending therebetween and forming a buckle therebetween:

speed control means for moving said photoreceptor support surface and said roll fusing assembly means at a pre-set speed differential for moving the lead area and the trail area of the same copy sheet at different speeds, said differing speeds causing a change in said buckle from a first position to a second position, a sensing mean for detecting the second position of said buckle and for generating a speed control signal sent to said speed control means for a predetermined length of time, so as to cause a change in the pre-set differential sufficient to restore the buckle to said first position.

3. The copying system of claim 1 wherein said speed control means include a first drive means for controlling the rotational speed of said photoreceptor and a second drive mean for controlling the rotation of said fuser assembly, at least one of said drive systems incorporating a stepper motor as the drive mechanism.

4. The copying system of claim 3 wherein said sensing means output signal is applied to said stepper motor.

5. The copying system of claim 3 wherein said predetermined speed differential is set so as to cause said second drive means to drive said fuser roll assembly at a rate equal to, or greater than the speed at which the photoreceptor is driven by said first drive means and wherein said sensing means output is applied to said second drive means.

* * * * *